US009302884B2

(12) United States Patent
Sugiura et al.

(10) Patent No.: US 9,302,884 B2
(45) Date of Patent: Apr. 5, 2016

(54) IMAGE FORMING APPARATUS

(71) Applicant: Brother Kogyo Kabushiki Kaisha, Nagoya-shi, Aichi-ken (JP)

(72) Inventors: Akihito Sugiura, Okazaki (JP); Hikaru Iino, Niwa-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 3 days.

(21) Appl. No.: 14/476,783

(22) Filed: Sep. 4, 2014

(65) Prior Publication Data

US 2015/0069698 A1 Mar. 12, 2015

(30) Foreign Application Priority Data

Sep. 9, 2013 (JP) ..... 2013-185941

(51) Int. Cl.

| | |
|---|---|
| ***B65H 29/00*** | (2006.01) |
| ***B65H 85/00*** | (2006.01) |
| ***B41J 3/60*** | (2006.01) |
| ***B41J 13/00*** | (2006.01) |
| ***B65H 1/26*** | (2006.01) |
| ***B65H 5/38*** | (2006.01) |

(52) U.S. Cl.

CPC . *B65H 85/00* (2013.01); *B41J 3/60* (2013.01); *B41J 13/0045* (2013.01); *B65H 1/266* (2013.01); *B65H 5/38* (2013.01); *B65H 2301/33312* (2013.01); *B65H 2402/10* (2013.01); *B65H 2402/46* (2013.01); *B65H 2404/63* (2013.01)

(58) Field of Classification Search

CPC ..... B65H 9/101; B65H 15/02

USPC ..... 271/264, 65, 184–186, 224–225

See application file for complete search history.

(56) References Cited

U.S. PATENT DOCUMENTS

| | | | | |
|---|---|---|---|---|
| 5,953,575 | A * | 9/1999 | Park et al. | 399/401 |
| 8,205,883 | B2 * | 6/2012 | Fujita et al. | 271/303 |
| 2011/0236096 | A1 | 9/2011 | Miwa | |
| 2012/0025453 | A1 * | 2/2012 | Yamaguchi et al. | 271/225 |
| 2012/0228816 | A1 * | 9/2012 | Tomatsu | 271/3.19 |
| 2013/0043638 | A1 * | 2/2013 | Iino | 271/3.14 |

FOREIGN PATENT DOCUMENTS

| | | | |
|---|---|---|---|
| EP | 2369415 | A2 | 9/2011 |
| JP | H08-169589 | A | 7/1996 |
| JP | 2008-120510 | A | 5/2008 |
| JP | 2011-195318 | A | 10/2011 |

* cited by examiner

*Primary Examiner* — Thomas Morrison

(74) *Attorney, Agent, or Firm* — Banner & Witcoff, Ltd.

(57) ABSTRACT

An image forming apparatus includes an image forming unit configured to form an image on a sheet, and a re-feeding mechanism configured to re-feed the sheet to the image forming unit. The re-feeding mechanism includes a fixed guide configured to guide the sheet fed in a sheet feed direction and having a guide surface partially defining re-feeding path through which the sheet passes, a base guide disposed downstream of the fixed guide, and a movable guide having a guide surface and configured to guide the sheet guided by the fixed guide and to move toward and away from the base guide. The fixed guide includes an engaging portion and the movable guide includes an engaging portion. The guide surface of the movable guide is positioned relative to the guide surface of the fixed guide when the engaging portion of the movable guide engages the engaging portion of the fixed guide.

12 Claims, 9 Drawing Sheets

IMAGE FORMING APPARATUS

CROSS REFERENCE TO RELATED APPLICATION

This application claims priority from Japanese Patent Application No. 2013-185941, filed on Sep. 9, 2013 which is incorporated herein by reference in its entirety.

TECHNICAL FIELD

Aspects of the disclosure relate to an image forming apparatus and an image forming system, specifically relate to a re-feeding mechanism configured to re-feed a sheet having image to an image forming unit.

BACKGROUND

A known image forming apparatus includes an image forming unit configured to form an image on a sheet, a re-feeding mechanism configured to re-feed the sheet having the image to the image forming unit, and a main body including the image forming unit and the re-feeding mechanism. Specifically, the re-feeding mechanism includes a first guide detachably attached to the main body and a second guide disposed at the main body.

SUMMARY

However, for cases where the re-feeding mechanism includes a plurality of guides described above, manufacturing errors of the guides may lead to variations in positions of guide surfaces of the guides.

Illustrative aspects of the disclosure provide an image forming apparatus configured to reduce variations in positions of guide surfaces of guides constituting a re-feeding mechanism.

According to an aspect of the disclosure, an image forming apparatus includes a main body including an image forming unit configured to form an image on a sheet, and a re-feeding mechanism configured to re-feed the sheet having a first image on a first surface thereof to the image forming unit for forming a second image on a second surface of the sheet at the image forming unit. The re-feeding mechanism includes a fixed guide, a base guide, and a movable guide. The fixed guide is positioned relative to the main body and configured to guide the sheet fed in a sheet feed direction toward the image forming unit, and has a guide surface partially defining a re-feeding path through which the sheet passes. The base guide is disposed downstream of the fixed guide in the sheet feed direction. The movable guide has a guide surface facing the base guide and partially defining the re-feeding path. The movable guide is configured to guide the sheet guided by the fixed guide and to move toward and away from the base guide. The fixed guide includes an engaging portion, and the movable guide includes an engaging portion. The guide surface of the movable guide is positioned relative to the guide surface of the fixed guide when the engaging portion of the movable guide engages the engaging portion of the fixed guide.

With this structure, variations in positions of the guide surfaces of the movable guide and the fixed guide constituting the re-feeding mechanism can be reduced.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. The following description starts with an outline configuration of a color printer 1 as an example of an image forming apparatus, followed by features of the disclosure.

In the following description, the expressions "the front or front side", "the rear or rear side", "the top or upper side", "the bottom or lower side", "the right or right side", and "the left or left side" are used to define the various parts when the color laser printer 1 is disposed in an orientation in which it is intended to be used.

Outline Configuration of Color Printer

Figure 1:
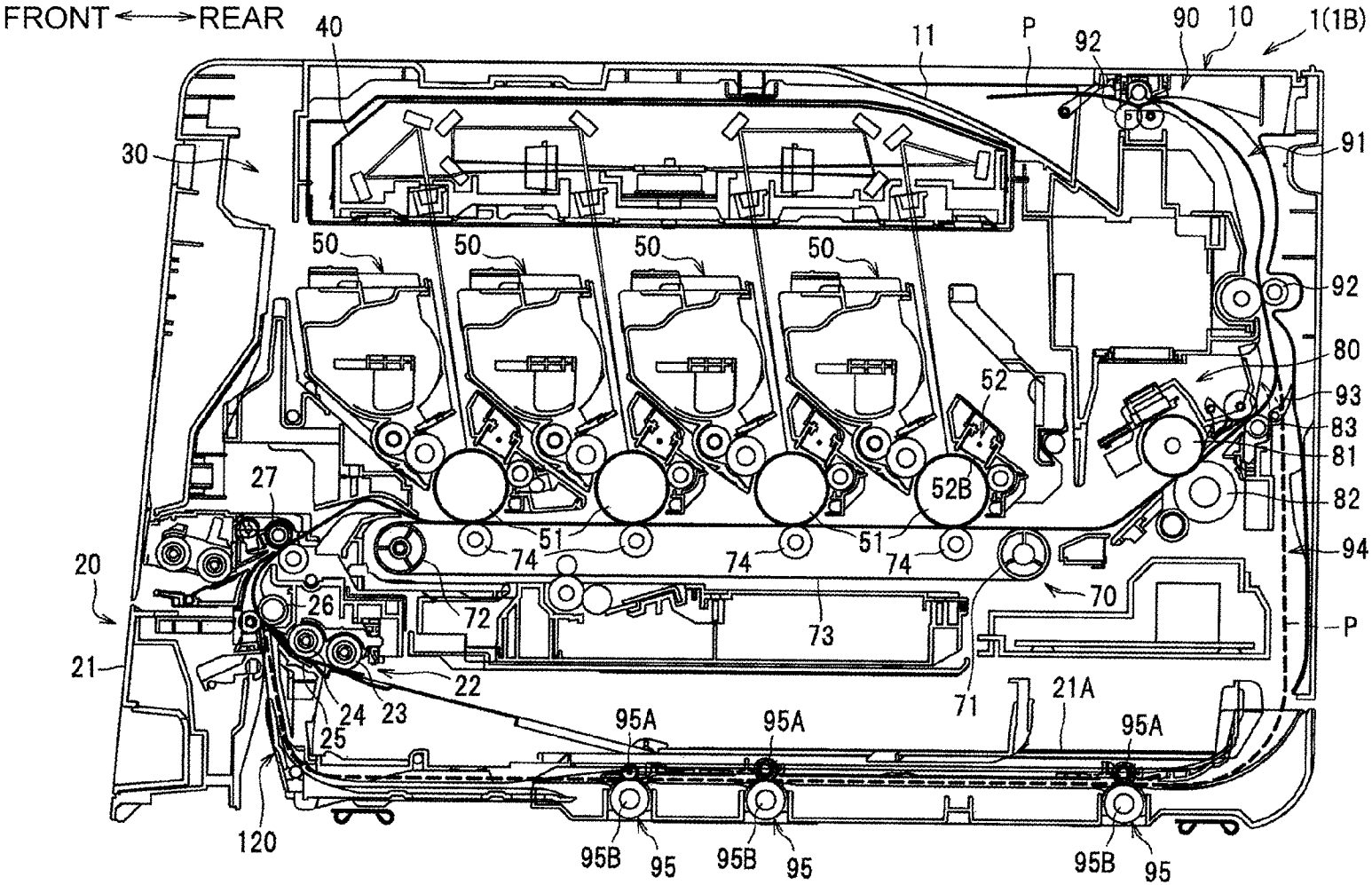
FIG. 1 is a sectional view of an illustrative color printer according to an embodiment of the disclosure.

As illustrated in FIG. 1, the color printer 1 is an apparatus that is capable of forming an image on each of two sides of a piece of paper P, which is as an example of a sheet. The color printer 1 basically includes, in a main body 10, a sheet supply unit 20, an image forming unit 30, and a feeding mechanism 90.

The sheet supply unit 20 is disposed in a lower portion of the main body 10 and basically includes a sheet supply tray 21 and a sheet supply mechanism 22. The sheet supply mechanism 22 is disposed in a front portion of the sheet supply tray 21 and includes a sheet supply roller 23, a separation roller 24, a separation pad 25, a paper-powder-removing roller 26, and a registration roller 27. The paper-powder-removing roller 26 and the registration roller 27 are exemplary feeding rollers.

Each of pieces of paper P contained in the sheet supply tray 21 is fed from the front side toward the rear side of the main body 10 in such a manner as to make a U-turn and is supplied to the image forming unit 30 by the sheet supply mechanism 22. The sheet supply tray 21 is detachable from the main body 10 by drawing the sheet supply tray 21 toward the front side and is attachable to the main body 10 by pushing the sheet supply tray 21 toward the rear side. The sheet supply tray 21 lies at the bottom of the main body 10 and extends in the front-rear direction.

The image forming unit 30 is disposed above the sheet supply tray 21 and is configured to form an image on the piece of paper P that is fed thereto from the sheet supply unit 20. The image forming unit 30 basically includes an exposure unit 40, a plurality of, e.g., four, process units 50, a transfer unit 70, and a fixing unit 80.

The exposure unit 40 is disposed in an upper portion of the main body 10 and basically includes a laser light source, not illustrated, a polygonal mirror, a plurality of lenses, and a plurality of reflecting mirrors, which are all illustrated without reference numerals. Laser light emitted from the laser light source on the basis of image data is reflected by the polygonal mirror and the reflecting mirrors, is transmitted through each of the lenses, and is scanningly moved along the surface of each of photosensitive drums 51 at a high speed.

The process units 50 are disposed between the sheet supply tray 21 and the exposure unit 40 and are arranged side by side in the front-rear direction. The process units 50 basically include the respective photosensitive drums 51, respective chargers 52, respective developing rollers, respective supply rollers, respective layer-thickness-regulating blades, and respective toner containers, which are all illustrated without reference numerals.

The transfer unit 70 is disposed between the sheet supply tray 21 and the process units 50 and basically includes an endless feeding belt 73 and four transfer rollers 74. The feeding belt 73 is stretched between a drive roller 71 and a driven roller 72. The outer surface of the feeding belt 73 is in contact with the photosensitive drums 51. The transfer rollers 74 are disposed on the inner side of the feeding belt 73 such that the feeding belt 73 is nipped between the transfer rollers 74 and the photosensitive drums 51.

The fixing unit 80 is disposed behind the process units 50 and basically includes a heat roller 81 and a pressure roller 82 that is pressed against the heat roller 81.

In the image forming unit 30, the surfaces of the photosensitive drums 51 are uniformly charged by the respective chargers 52, and the surfaces are exposed to the laser light emitted from the exposure unit 40, whereby electrostatic latent images based on the image data are formed on the respective photosensitive drums 51. Toners in the toner containers are supplied to the respective developing rollers via the respective supply rollers and advance into the nips between the respective developing rollers and the respective layer-thickness-regulating blades, whereby thin toner layers each having a specific thickness are formed on the respective developing rollers.

Then, the toners on the developing rollers are supplied to the respective photosensitive drums 51 having the electrostatic latent images, whereby the electrostatic latent images are visualized. Thus, toner images are formed on the respective photosensitive drums 51. Subsequently, the piece of paper P supplied from the sheet supply unit 20 is fed through the nips between the photosensitive drums 51 and the feeding belt 73 (the transfer rollers 74), whereby the toner images on the respective photosensitive drums 51 are transferred to the piece of paper P in such a manner as to be sequentially superposed one on top of another.

The piece of paper P having the toner images transferred thereto is fed through the nip between the heat roller 81 and the pressure roller 82, whereby the toner images are fixed with heat. Thus, an image is formed on the piece of paper P. The piece of paper P now having the image is fed out of the fixing unit 80 into a feeding path 91 by a feeding roller 83.

The feeding mechanism 90 functions as an ejecting mechanism that ejects, to the outside of the main body 10, the piece of paper P that has been fed out of the image forming unit 30. The feeding mechanism 90 also functions as a re-feeding mechanism that re-feeds, to the image forming unit 30, the piece of paper P having the image formed on one side thereof by the image forming unit 30 and having been turned over. Specifically, the feeding mechanism 90 basically includes the feeding path 91, an ejection roller 92, a flapper 93 pivotable in the front-rear direction, a re-feeding path 94, and pairs of re-feeding rollers 95 that feed the piece of paper P in the re-feeding path 94.

The feeding path 91 is provided in a rear portion of the main body 10. The feeding path 91 extends upward from near a position frontward of the flapper 93 (shown by solid lines) that has been pivoted rearward, and curves toward the front side.

The ejection roller 92 is capable of rotating in a normal direction and in a reverse direction. When the ejection roller 92 rotates in the normal direction, the piece of paper P that has been fed out of the image forming unit 30 is ejected toward the outside of the main body 10. When the ejection roller 92 rotates in the reverse direction, the piece of paper P is drawn into the main body 10. The flapper 93 is pivoted rearward when the piece of paper P that has been fed out of the image forming unit 30 is to be guided into the feeding path 91, and is pivoted frontward when the piece of paper P that has been drawn into the main body 10 with the reverse rotation of the ejection roller 92 is to be fed again or re-fed into the image forming unit 30.

The re-feeding path 94 is provided for re-feeding the piece of paper P having an image formed on one side thereof by the image forming unit 30 to the image forming unit 30. The re-feeding path 94 has a substantially U shape in side view, extending along the rear side, along the lower side, and along the front side of the main body 10. Specifically, the re-feeding path 94 first extends downward from near a position rearward of the flapper 93 (shown by chain lines) that has been pivoted frontward, curves toward the front side, extends below a sheet receiving portion 21A of the sheet supply tray 21 up to the front side of the sheet receiving portion 21A, and curves upward to the paper-powder-removing roller 26. The sheet receiving portion 21A receives pieces of paper P.

In the feeding mechanism 90, when the formation of an image is complete, the piece of paper P that has been fed out of the image forming unit 30 is fed along the feeding path 91, is ejected to the outside of the main body 10 by the ejection roller 92 rotating in the normal direction, and is received on an ejection tray 11. If another image is to be formed on the other side of the piece of paper P having the image on one side thereof, the ejection roller 92 rotates in the reverse direction before the entirety of the piece of paper P is completely ejected out of the main body 10, whereby the piece of paper P is drawn back into the main body 10 and is fed from the feeding path 91 into the re-feeding path 94. Subsequently, the piece of paper P (shown by a broken line) is fed along the re-feeding path 94 by the re-feeding rollers 95 and is re-fed into the image forming unit 30 by the sheet supply mechanism 22.

The piece of paper P having another image formed on the other side thereof by the image forming unit 30 is fed out of the image forming unit 30 into the feeding path 91, is ejected to the outside of the main body 10 by the ejection roller 92 rotating in the normal direction, and is received on the ejection tray 11.

Image Forming System

Figure 9:
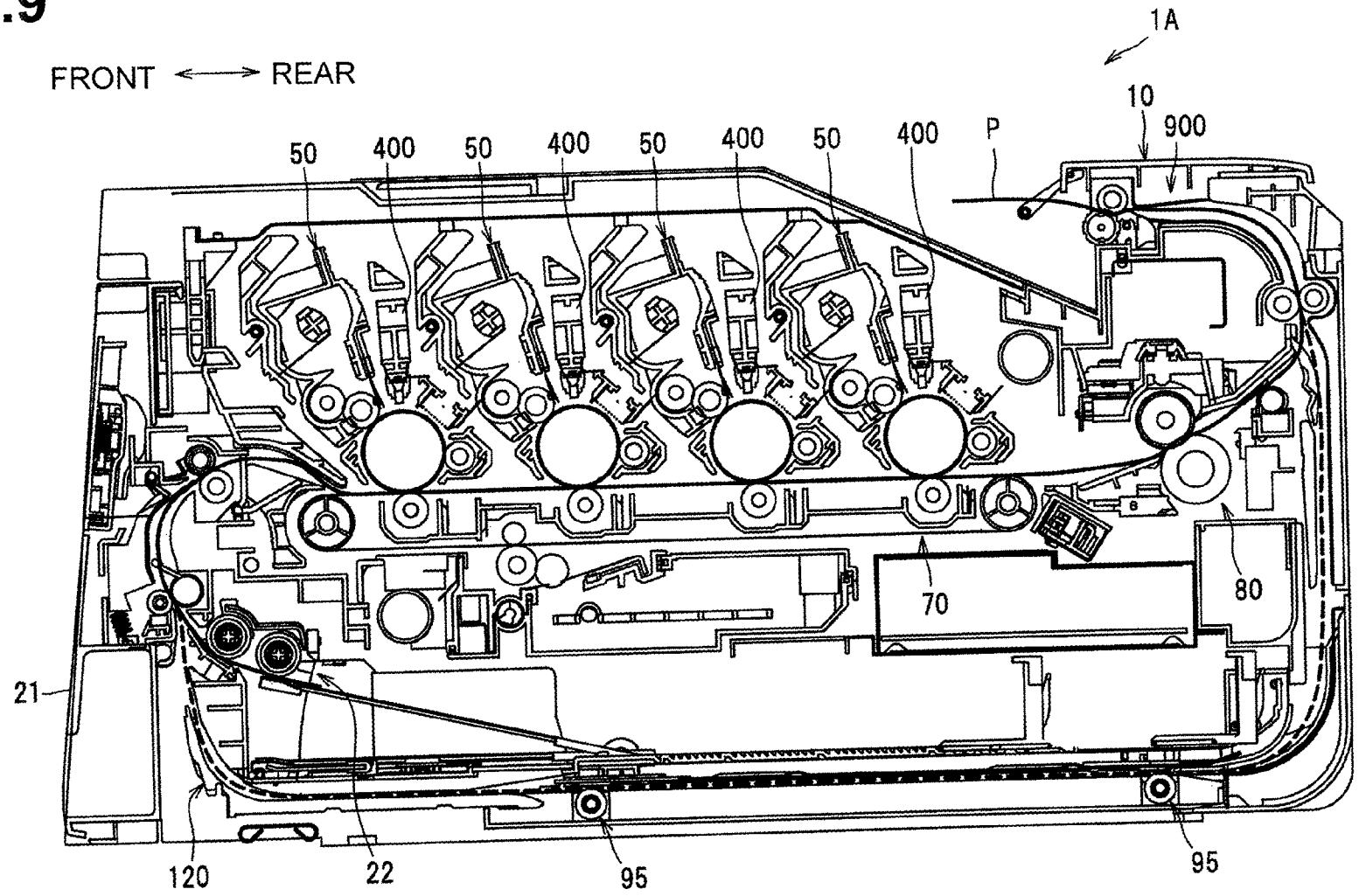
FIG. 9 is a sectional view of the first color printer.

As schematically illustrated in FIGS. 2A to 2C and 3A to 3C, an image forming system S according to the present embodiment includes a first color printer 1A (see FIGS. 2A to 2C) as an example of a first image forming apparatus, and a second color printer 1B (see FIGS. 3A to 3C), as an example of a second image forming apparatus, which is slightly different in configuration from the first color printer 1A. The second color printer 1B has the same configuration as the color printer 1 described above. Referring to FIG. 9, the first color printer 1A includes a main body 10, a sheet supply tray 21, a sheet supply mechanism 22, a transfer unit 70, and a fixing unit 80, which are substantially the same as those of the second color printer 1B.

The first color printer 1A differs from the second color printer 1B in that exposure members for exposing the photosensitive drums 51 to light are light-emitting-diode (LED) units 400. The first color printer 1A further differs from the second color printer 1B in the configuration of a lower portion of a feeding mechanism 900, i.e. a portion of the re-feeding mechanism. For example, the re-feeding mechanism of the first color printer 1A includes two pairs of re-feeding rollers 95, whereas the re-feeding mechanism of the second color printer 1B includes three pairs of re-feeding rollers 95. The differences between the two re-feeding mechanisms will be described in detail separately below.

In other words, in the present embodiment, a first main body and a first supply tray have the same configurations as a second main body and a second supply tray, respectively, whereas a first image forming unit and a first re-feeding mechanism have slightly different configurations from a second image forming unit and a second re-feeding mechanism, respectively. The present invention is not limited to such a case. For example, the first image forming unit and the second image forming unit may have the same configuration. Instead, the first main body and the second main body may have different configurations.

Figure 2A:
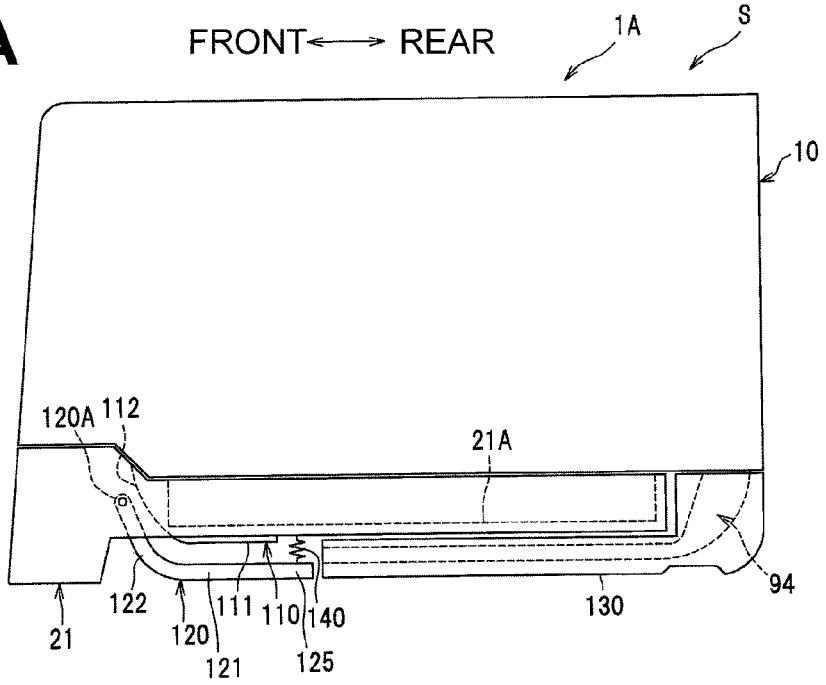
FIGS. 2A, 2B, and 2C schematically illustrate a first color printer.

As illustrated in FIG. 2A, the re-feeding mechanism of the first color printer 1A basically includes a base guide 110 that is to face the upper side of the piece of paper P, a movable guide 120 that is to face the lower side of the piece of paper P and is pivotable toward and away from the base guide 110, and a first fixed guide 130 that is disposed adjacent to a rear end of the movable guide 120.

The base guide 110 is formed integrally with the sheet supply tray 21 and extends while curving obliquely upward from a lower front part of the sheet receiving portion 21A toward the front side. Specifically, the base guide 110 includes a first base portion 111 and a second base portion 112. The first base portion 111 extends in a substantially front-rear direction over the lower front part of the sheet receiving portion 21A. The second base portion 112 extends while curving obliquely upward from the front end of the first base portion 111 toward the front side.

The movable guide 120 has a substantially L shape in side view. The movable guide 120 is spaced downward and frontward from the base guide 110, whereby the re-feeding path 94 is provided between the movable guide 120 and the base guide 110. The movable guide 120 has a guide surface facing the base guide 110 and partially defining the re-feeding path 94. Specifically, the movable guide 120 includes a front-rear extending portion 121 positioned below the first base portion 111 and extending in the front-rear direction, and a curved portion 122 extending while curving obliquely upward from the front end of the front-rear extending portion 121 toward the front side. The curved portion 122 is positioned obliquely downward to the front of the second base portion 112.

The movable guide 120 configured as described above guides the piece of paper P from the rear side toward the front side along the front-rear extending portion 121 and changes a feed direction of the piece of paper P to an upward direction along the curved portion 122. Specifically, as illustrated in FIG. 1, the movable guide 120 changes the feed direction of the piece of paper P that has been fed from the rear side toward the front side of the movable guide 120 to a direction toward an upper front side, thereby guiding the piece of paper P toward the paper-powder-removing roller 26.

The feed direction in the present embodiment refers to a direction determined by the associated rollers, guides, and so forth. For example, the feed direction of the piece of paper P that is fed along the front-rear extending portion 121 is the front-rear direction. Note that obliquely feeding rollers 95A to be described separately below (see FIG. 7) may temporarily feed the piece of paper P in an oblique direction with respect to the front-rear direction. However, any piece of paper P that is fed in the oblique direction is prevented from moving in the width direction by an end regulating member 160. Consequently, such a piece of paper P is fed in the front-rear direction. Therefore, even while obliquely feeding rollers 95A feed the piece of paper P, the feed direction is the front-rear direction.

As illustrated in FIG. 2A, an upper end portion 120A of the movable guide 120, i.e., a downstream end of the curved portion 122 in the feed direction, is rotatably connected to the sheet supply tray 21. Hence, the movable guide 120 is pivotable about the upper end portion 120A and with respect to the sheet supply tray 21. Furthermore, a rear end portion 125 of the movable guide 120 is supported by a tension coil spring 140, as an example of an urging member, which is disposed at the sheet supply tray 21.

Figure 2B:
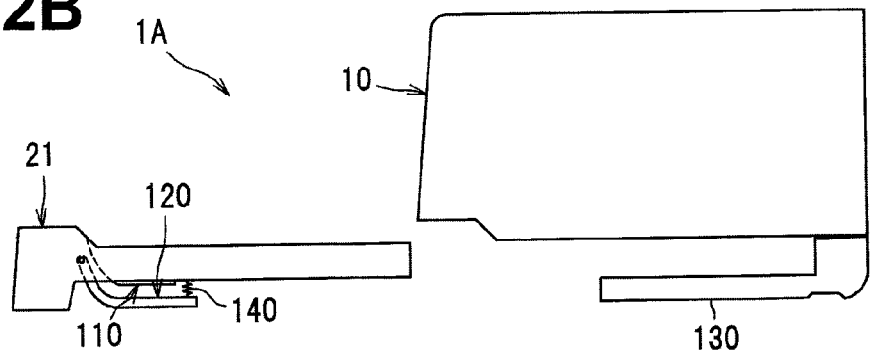

As illustrated in FIG. 2B, the base guide 110 and the movable guide 120 configured as described above are detachable from the main body 10, together with the sheet supply tray 21.

Figure 2C:
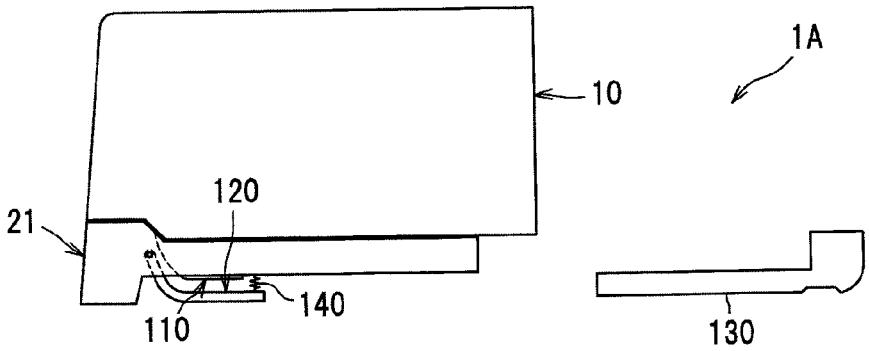

The first fixed guide 130 is a member in which the re-feeding path 94 is provided. As illustrated in FIG. 2C, the first fixed guide 130 is detachable from the main body 10. When the first fixed guide 130 is attached to the main body 10, the first fixed guide 130 is in contact with a portion of the main body 10 and is thus positioned with respect to the main body 10, with the lower front portion thereof extending below the sheet supply tray 21.

When the first fixed guide 130 is positioned with respect to the main body 10, a gap is provided between the first fixed guide 130 and the movable guide 120. Hence, the rear end portion 125 of the movable guide 120 is disengaged from the first fixed guide 130 and supported by the tension coil spring 140, and the movable guide 120 is positioned at a first position with respect to the base guide 110. That is, the guide surface of the movable member 120 is positioned by the tension coil spring 140. The movable guide 120 may alternatively be positioned at the first position by bringing the rear end portion 125 of the movable guide 120 into contact with a portion of the main body 10 or a portion of the sheet supply tray 21 with the urging force exerted by the tension coil spring 140.

Figure 3A:
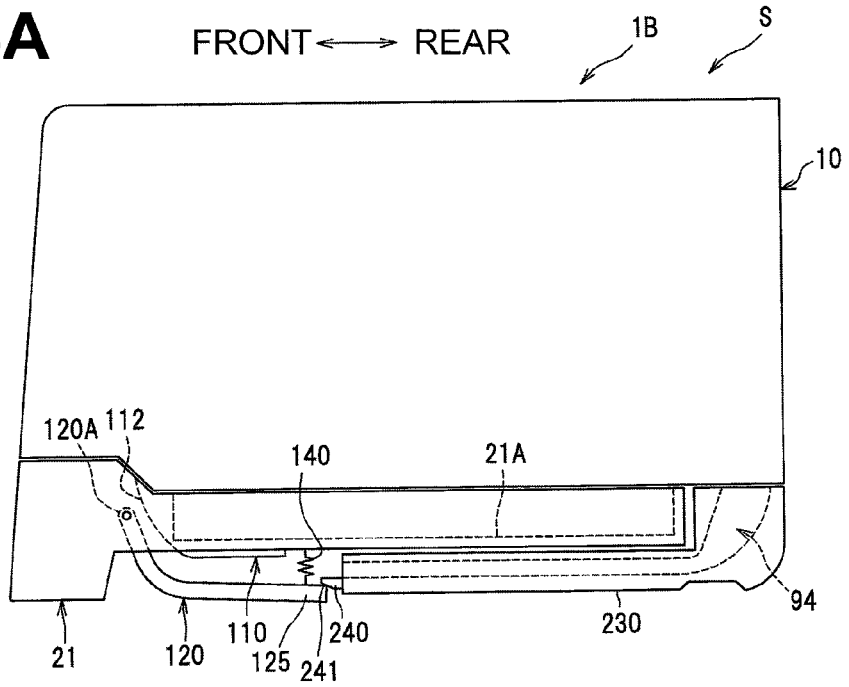
FIGS. 3A, 3B, and 3C illustrate a second color printer.

As illustrated in FIG. 3A, the re-feeding mechanism of the second color printer 1B includes the base guide 110, the movable guide 120, and the tension coil spring 140, which are similar to those of the first color printer 1A, and also includes a second fixed guide 230 having a slightly different configuration from the first fixed guide 130.

The second fixed guide 230 is a member in which the re-feeding path 94 is provided, and is disposed adjacent to a rear end of the movable guide 120. As illustrated in FIG. 3C, the second fixed guide 230 is detachable from the main body 10. When the second fixed guide 230 is attached to the main body 10, the second fixed guide 230 is in contact with a portion of the main body 10 and is thus positioned with respect to the main body 10. The second fixed guide 230 has a guide surface partially defining the re-feeding path 94.

The second fixed guide 230 includes, at the front end thereof, an engaging portion 240 that is configured to engage the rear end portion 125 of the movable guide 120 from the upper side with the second fixed guide 230 being attached to the main body 10. Hence, in the second color printer 1B, when the movable guide 120 engages the engaging portion 240, the movable guide 120 is pushed downward against the urging force exerted by the tension coil spring 140, whereby the movable guide 120 is moved with respect to the base guide 110 from a first position (an initial position) to a second position (a predetermined position), where the movable guide 120 is positioned. That is, when the rear end portion 125 of the movable guide 120 engages the engaging portion 240, the guide surface of the movable guide 120 is positioned relative to the guide surface of the movable guide 120.

In the first color printer 1A, a predetermined gap is provided between the movable guide 120 and the base guide 110 because the movable guide 120 is positioned at the first position. In the second color printer 1B, the gap between the movable guide 120 and the base guide 110 is larger than the predetermined gap because the movable guide 120 is positioned at the second position that is lower than the first position.

A configuration of a portion of the re-feeding mechanism mentioned above will now be described in more detail.

Figure 4:
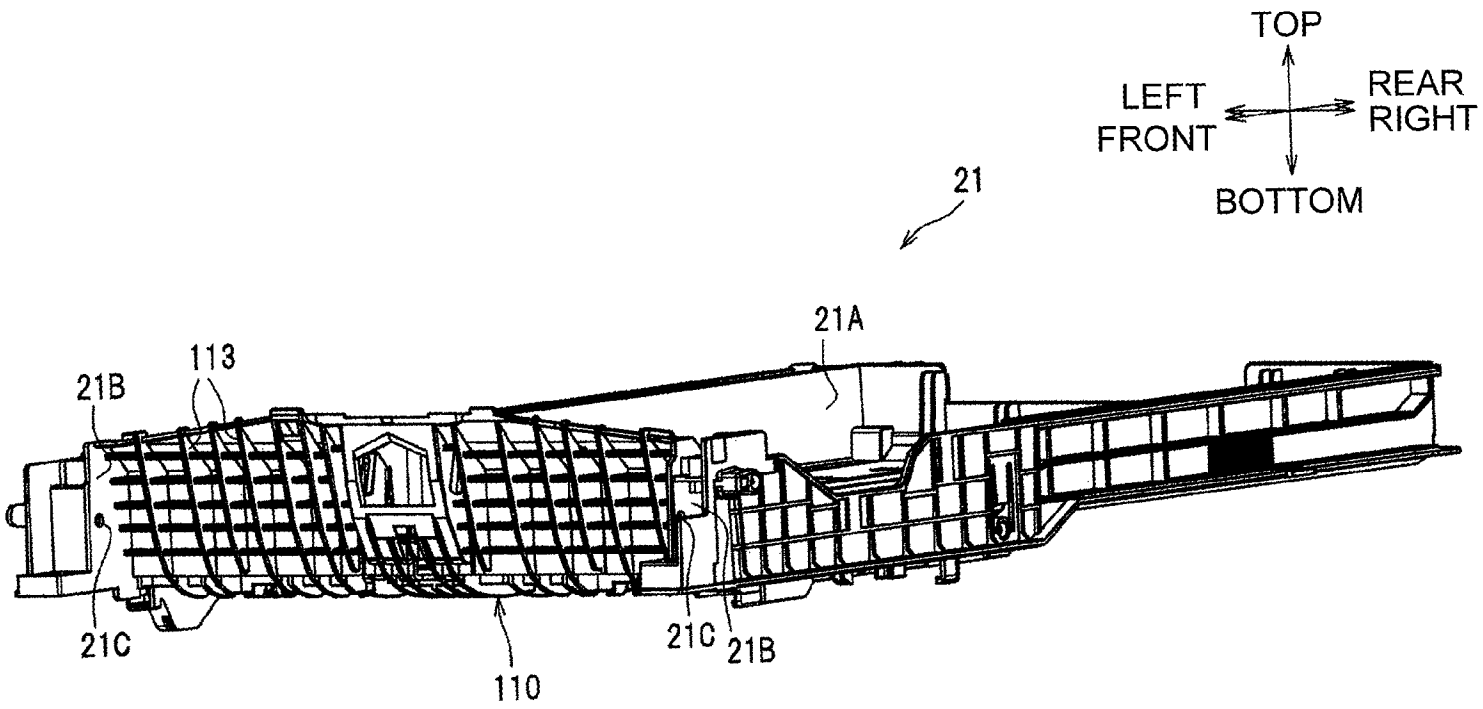
FIG. 4 is a perspective view of a sheet supply tray.

As illustrated in FIG. 4, the sheet receiving portion 21A of the sheet supply tray 21 has a rectangular container shape that is open at the top. The base guide 110 is formed integrally with the sheet receiving portion 21A in such a manner as to extend over the front wall and a front part of the bottom wall of the sheet receiving portion 21A. The base guide 110 includes a plurality of ribs 113 each having a substantially L shape and protruding outward from the front wall and the bottom wall of the sheet receiving portion 21A. The ribs 113 are arranged at intervals in the left-right direction.

The sheet receiving portion 21A has a pair of supporting walls 21B provided on the front wall thereof and on the right and left ends, respectively, of the base guide 110. The supporting walls 21B each protrude frontward more than the ribs 113. The supporting walls 21B have respective supporting holes 21C that support the movable guide 120 such that the movable guide 120 is pivotable.

Figure 5:
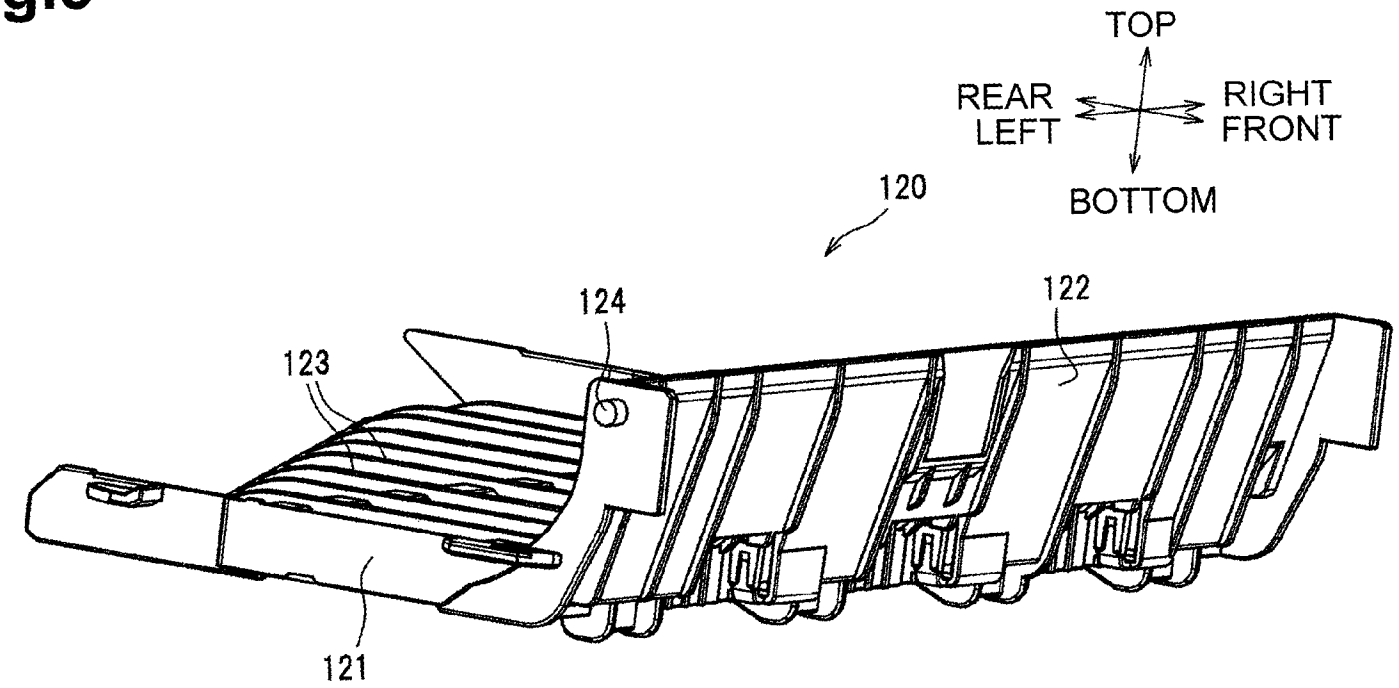
FIG. 5 is a perspective view of a movable guide.

As illustrated in FIG. 5, the front-rear extending portion 121 of the movable guide 120 includes a plurality of ribs 123 on the upper surface thereof. The ribs 123 each extend in the front-rear direction and are arranged at intervals in the left-right direction. The curved portion 122 of the movable guide 120 has rotational shaft portions 124 provided on upper portions of right and left side faces, respectively, thereof. The rotational shaft portions 124 protrude outward from the right and left side surfaces, respectively, in such a manner as to be fitted into and supported by the respective supporting holes 21C (see FIG. 4).

Figure 6:
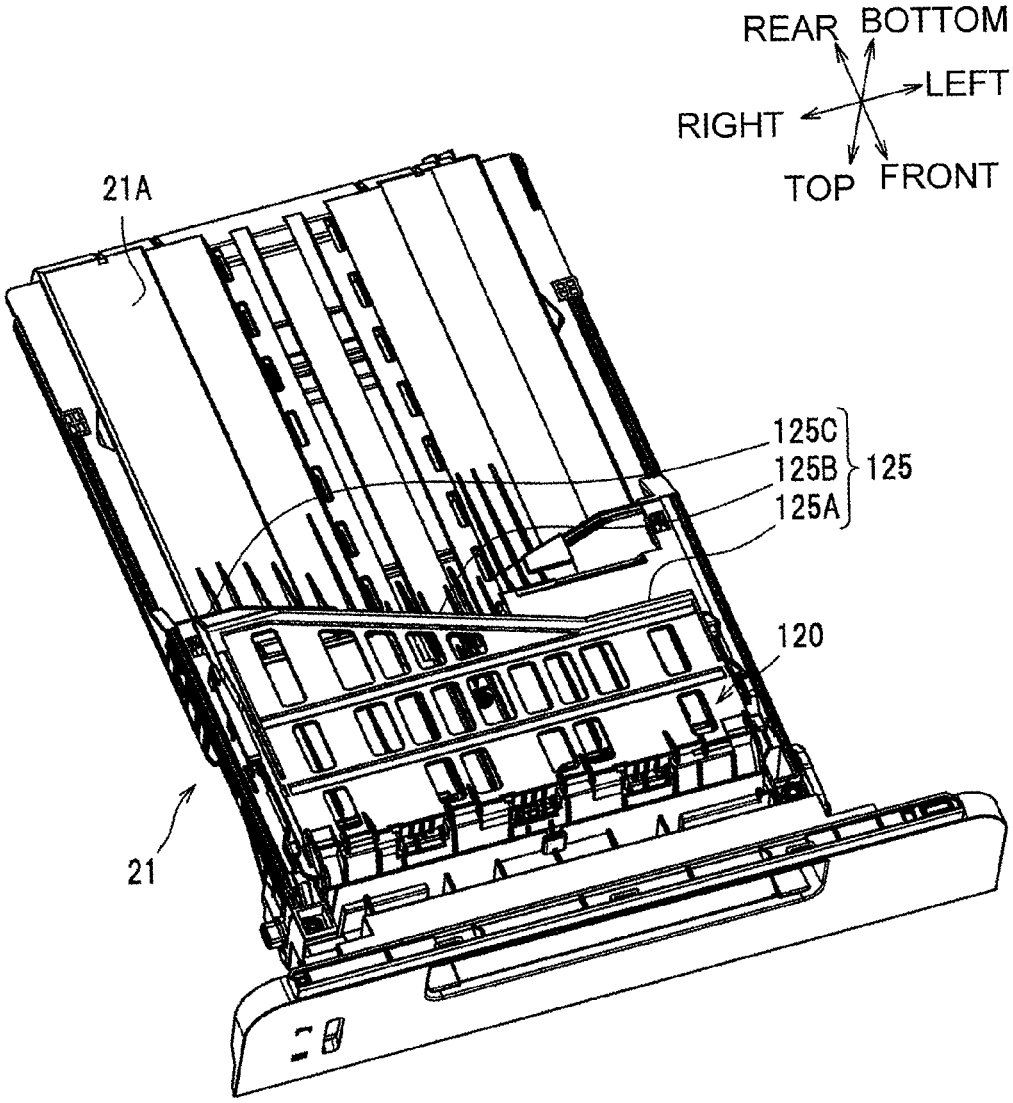
FIG. 6 is a perspective view of the sheet supply tray viewed from below.

As illustrated in FIG. 6, in a state where the movable guide 120 and the sheet supply tray 21 are assembled together, the movable guide 120 covers substantially a front half of the sheet receiving portion 21A of the sheet supply tray 21 from below. The rear end portion 125 of the movable guide 120 includes a left-side rear end part 125A disposed on a left end portion of the rear end portion 125 (one end in a direction perpendicular to the sheet feed direction) and extending in the left-right direction, a central rear end part 125B extending obliquely from the left-side rear end part 125A toward the right rear side, and a right-side rear end part 125C extending from the central rear end part 125B toward the right end along the left-right direction.

Figure 7:
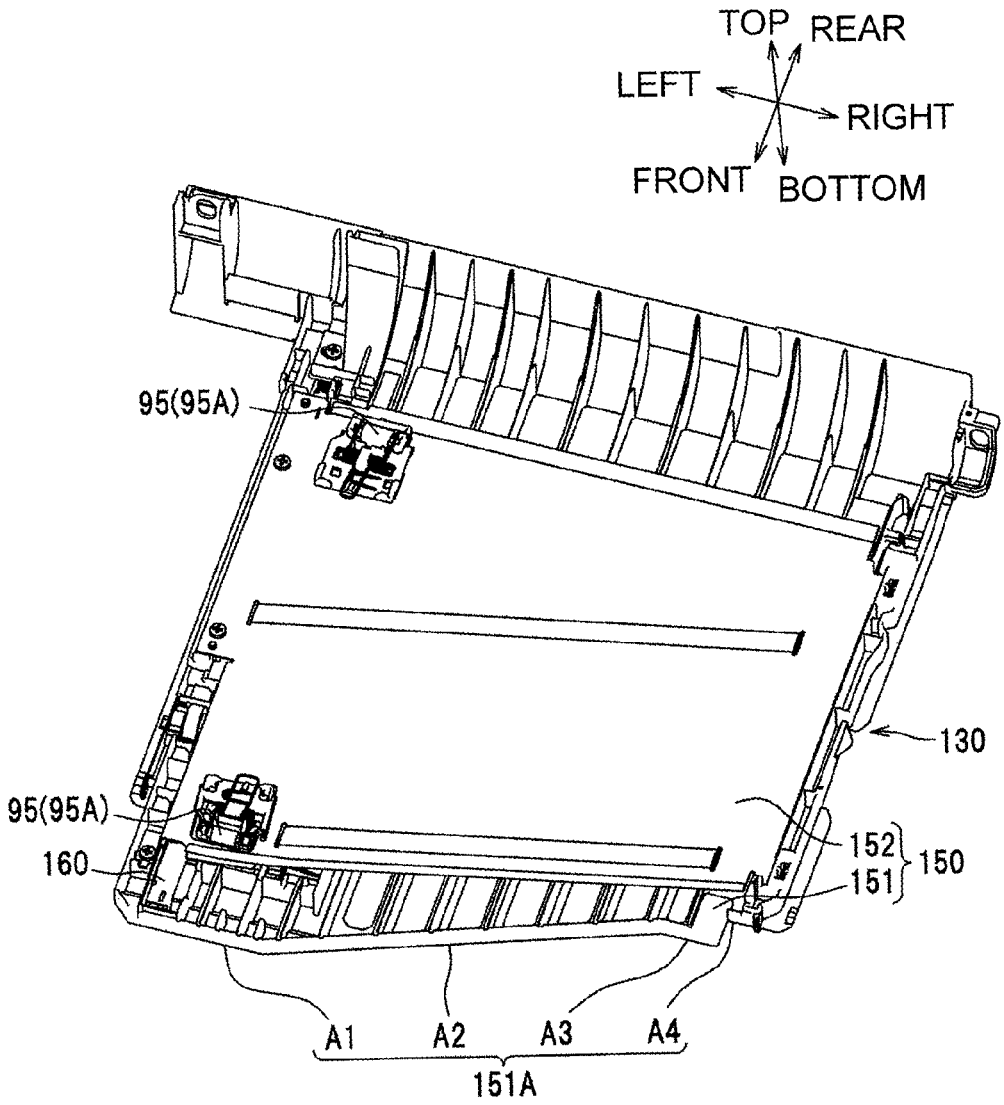
FIG. 7 is a perspective view of a first fixed guide.

As illustrated in FIG. 7, the first fixed guide 130 has substantially a flat plate-like shape and basically includes a guide body 150, the end regulating member 160, and two pairs of re-feeding rollers 95.

The guide body 150 includes a lower guide 151 and an upper guide 152 that are disposed with a gap interposed therebetween in the vertical direction. The re-feeding path 94 (see FIG. 1) is provided between the lower guide 151 and the upper guide 152.

The lower guide 151 is a resin member and has a front end portion 151A having a shape substantially conforming to the rear end portion 125 of the movable guide 120 described above. Specifically, the front end portion 151A includes a left-side front end part A1, as an example of a first end part, which conforms to the left-side rear end part 125A of the movable guide 120, a central front end part A2, as an example of a second end part, which conforms to the central rear end part 125B of the movable guide 120, a first right-side front end part A3, which conforms to the right-side rear end part 125C of the movable guide 120, and a second right-side front end part A4, as an example of a third end part.

The left-side front end part A1 is disposed on a left end portion of the lower guide 151 and extends in the left-right direction. The central front end part A2 is disposed adjacent to a right end of the left-side front end part A1, and extends obliquely from the left-side front end part A1 toward the right rear side. The first right-side front end part A3 is disposed adjacent to a right end of the central front end part A2, and extends from the central front end part A2 toward the right side along the left-right direction. The second right-side front end part A4 is disposed in a rearward position relative to the first right-side front end part A3 and extends in the left-right direction.

The upper guide 152 is made of sheet metal with left and right ends thereof being bent downward and fixed to the lower guide 151. The end regulating member 160 is disposed between the upper guide 152 and the lower guide 151.

The end regulating member 160 regulates the position of the left end of the piece of paper P by contacting the left end of the piece of paper P. The end regulating member 160 has a long narrow shape extending in the front-back direction and is disposed on a left portion of the lower guide 151. The upper guide 152 is provided, on a left portion thereof, with two obliquely feeding rollers 95A configured to feed the piece of paper P obliquely with respect to the front-rear direction. The obliquely feeding rollers 95A are arranged at an interval in the front-rear direction. Specifically, the two obliquely feeding rollers 95A are arranged separately from each other at the front portion and the rear portion, respectively, of the first fixed guide 130.

Each pair of re-feeding rollers 95 includes an obliquely feeding roller 95A provided on the upper guide 152 and a drive roller (not illustrated) provided on the lower guide 151. The drive roller is provided such that the axis of rotation thereof extends in the left-right direction. The obliquely feeding roller 95A is provided such that the axis of rotation thereof is tilted with respect to the axis of rotation of the drive roller.

Hence, when the drive rollers are rotated, the obliquely feeding rollers 95A that rotate by following the rotation of the drive rollers feed the piece of paper P obliquely toward left front side, whereby the piece of paper P is deflected toward the end regulating member 160.

Figure 8:
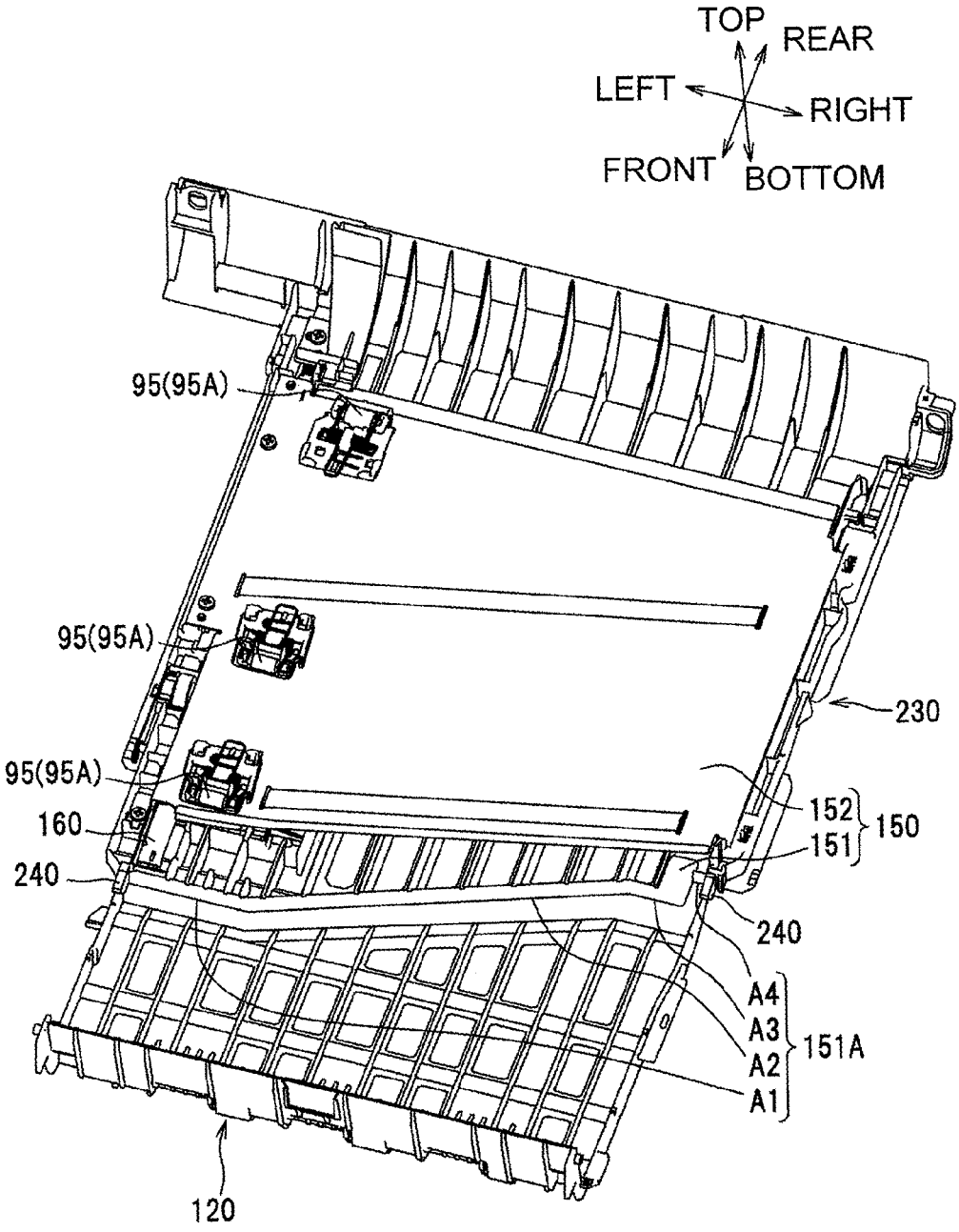
FIG. 8 is a perspective view of the movable guide and a second fixed guide.

As illustrated in FIG. 8, the second fixed guide 230 includes the guide body 150 and the end regulating member 160, which are similar to those of the first fixed guide 130. Furthermore, the second fixed guide 230 includes more pairs, specifically, three pairs, of re-feeding rollers 95 than the first fixed guide 130, and two engaging portions 240, which are not included in the first fixed guide 130. Specifically, the three pairs of re-feeding rollers 95 include respective obliquely feeding rollers 95A, below which respective drive rollers 95B (see FIG. 1) are provided.

Among the three pairs of re-feeding rollers 95, two pairs of re-feeding rollers 95 are located in upstream and downstream portions of the second fixed guide 230, respectively, and the remaining pair of re-feeding rollers 95 is located closer to the downstream pair of re-feeding rollers 95 than to the upstream pair of re-feeding rollers 95.

One of the two engaging portions 240 protrudes frontward of the left-side front end part A1 of the lower guide 151 of the second fixed guide 230, and the other engaging portion 240 protrudes frontward of the second right-side front end part A4. Specifically, the engaging portions 240 are engageable with left and right outer edges (engaging portions), respectively, of the rear end portion 125 of the movable guide 120. Furthermore, as illustrated in FIG. 3A, the engaging portions 240 each have a corresponding engaging surface 241 that is engageable with the movable guide 120. The engaging surface 241 slopes obliquely toward the upper front side.

With the image forming system S configured as described above, in the first color printer 1A illustrated in FIGS. 2A to 2C, when the sheet supply tray 21 or the first fixed guide 130 that has been detached temporarily from the main body 10 is reattached to the main body 10, the movable guide 120 does not engage the first fixed guide 130. Therefore, the movable guide 120 is positioned at the first position.

Figure 3B:
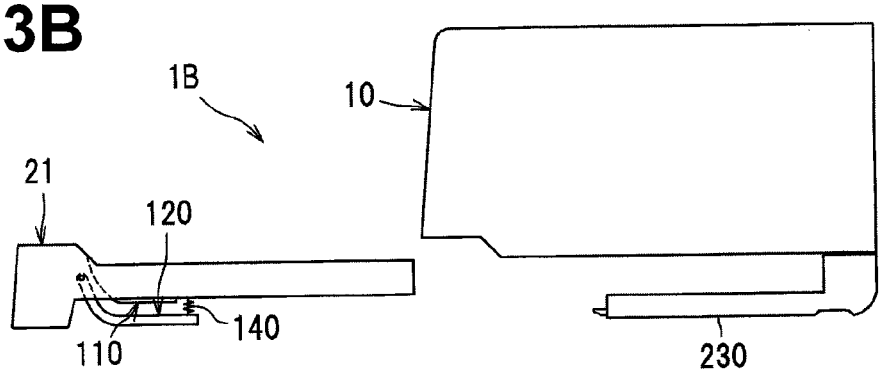
Figure 3C:
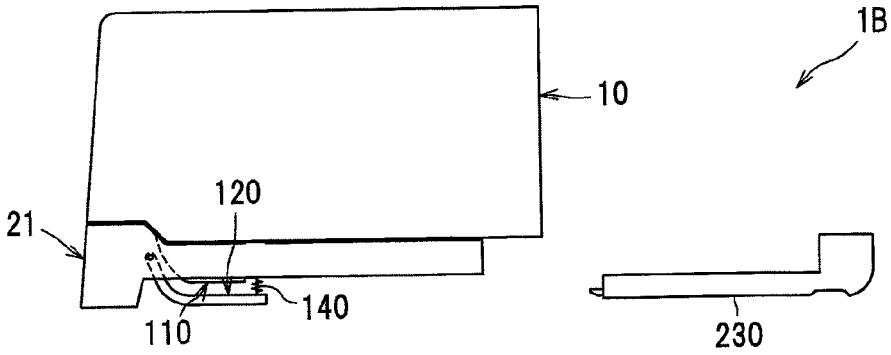

In the second color printer 1B illustrated in FIGS. 3A to 3C, when the sheet supply tray 21 or the second fixed guide 230 that has been detached temporarily from the main body 10 is reattached to the main body 10, the movable guide 120 is pushed downward by the engaging portions 240 of the second fixed guide 230 and is moved from the first position to the second position. Thus, the movable guide 120 is positioned at the second position. That is, the movable guides 120 of the respective color printers 1A and 1B that are of different types are each positioned appropriately. Therefore, the movable guides 120 are interchangeable between the color printers 1A and 1B.

In the present embodiment, the number of obliquely feeding rollers 95A provided on the second fixed guide 230 is larger than the number of obliquely feeding rollers 95A provided on the first fixed guide 130. Therefore, the piece of paper P is fed toward the movable guide 120 with a larger feeding force by the obliquely feeding rollers 95A of the second fixed guide 230 (specifically, two of the obliquely feeding rollers 95A that are disposed in the downstream portion of the second fixed guide 230). Accordingly, supposing that the gap between the base guide 110 and the movable guide 120 of the second color printer 1B is the same as that of the first color printer 1A, the feeding resistance applied to the piece of paper P between the guides 110 and 120 of the second color printer 1B may become large, and the piece of paper P may be stuck between the guides 110 and 120 of the second color printer 1B. However, in the present embodiment, the gap between the guides 110 and 120 of the second color printer 1B is widened by pushing the movable guide 120 downward by the second fixed guide 230. Therefore, the probability that the piece of paper P may be stuck between the guides 110 and 120 can be reduced.

Furthermore, in the present embodiment, since the movable guide 120 is pivotable about the downstream end of the curved portion 122 thereof, the orientation of the curved portion 122 can be changed suitably for each of the color printers 1A and 1B. Therefore, the angle at which the piece of paper P approaches the curved portion 122 can be changed suitably for each of the color printers 1A and 1B.

In the second color printer 1B, since the movable guide 120 is positioned by engaging with the second fixed guide 230, the movable guide 120 can be positioned accurately with respect to the second fixed guide 230. Accordingly, variation in the positions of the feeding surfaces of the guides 120 and 230 can be reduced.

In the present embodiment, the movable guide 120 is supported by the tension coil spring 140 in such a manner as to be positioned at the first position. Hence, in the second color printer 1B, when the sheet supply tray 21 or the second fixed guide 230 is detached from the main body 10, the movable guide 120 is moved from the second position to the first position with the urging force exerted by the tension coil spring 140. Therefore, when the sheet supply tray 21 or the second fixed guide 230 that has been detached is reattached to the main body 10, the engaging portions 240 of the second fixed guide 230 can be properly engaged with the movable guide 120 located at the first position. Thus, the movable guide 120 can be reliably moved from the first position to the second position.

In the present embodiment, since the movable guide 120 is pivotable, a mechanism that allows the movable guide to be operable is simpler in comparison with a case where, for example, the movable guide is vertically slidable.

In the present embodiment, the engaging portions 240 are provided outside the left-side front end part A1 and the second right-side front end part A4, respectively, that each extend in the left-right direction. Compared with a case where, for example, an engaging portion is provided on the central front end part A2 that extends obliquely with respect to the left-right direction, the engaging portions 240 and the movable guide 120 can be engaged with each other reliably and the movable guide 120 can be positioned accurately.

The present invention is not limited to the above embodiment and may be applicable to any of other various embodiments as described below.

The above embodiment shows but is not limited to that the movable guide 120 is pivotable. For example, the movable guide may be vertically slidable. The above embodiment shows but is not limited to the first color printer 1A in which the movable guide 120 is positioned without making the movable guide 120 engage the first fixed guide 130. The movable guide may be positioned at a different position from the second position by making the movable guide engage the first fixed guide.

The above embodiment shows but is not limited to that the movable guide 120 and the fixed guide (130 or 230) are both detachable from the main body 10. One of the movable guide and the fixed guide may be detachable, or neither of them may be detachable from the main body without using any tool or the like. Even if neither of the guides is detachable from the main body without using any tool or the like, the movable guide can be accurately positioned by making the movable guide engage the fixed guide in a process of assembling the image forming apparatus that is performed in a factory.

The above embodiment shows but is not limited to the tension coil spring 140 employed as an example of an urging member. The urging member may be a compression spring, such as a compression coil spring or a leaf spring, or any other tension spring, such as a torsion spring.

The above embodiment shows but is not limited to the paper P, such as cardboard, a postcard, or thin paper, which is employed as an example of a sheet. For example, the sheet may be a transparency.

The above embodiment shows but is not limited to that the disclosure is applied to the color printer 1. The disclosure may be also applicable to any of other image forming apparatuses such as a copier and a multifunction machine.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a main body including an image forming unit configured to form an image on a sheet;

a re-feeding mechanism configured to re-feed the sheet having a first image on a first surface thereof to the image forming unit for forming a second image on a second surface of the sheet at the image forming unit, the re-feeding mechanism including:

a fixed guide positioned in a lower portion of the main body and configured to guide the sheet fed in a sheet feed direction toward the image forming unit, the fixed guide having a guide surface partially defining a re-feeding path through which the sheet passes;

a base guide disposed downstream of the fixed guide in the sheet feed direction; and a movable guide having a guide surface facing the base guide and partially defining the re-feeding path, the movable guide being configured to guide the sheet guided by the fixed guide and to move toward and away from the base guide; and a sheet supply tray configured to be attached to and removed from the lower portion of the main body and to contain a stack of sheets to be supplied to the image forming unit, the sheet supply tray being disposed above the fixed guide when attached to the lower portion of the main body, a downstream portion of the sheet supply tray in the sheet feed direction including the base guide, the movable guide, and an urging member, the base guide and the movable guide partially defining the re-feeding path below the sheet supply tray, wherein the fixed guide, partially disposed below the sheet supply tray attached to the lower portion of the main body, includes a first engaging portion disposed in a first end portion of the fixed guide in a horizontal direction perpendicular to the sheet feed direction and a second engaging portion disposed in a second end portion of the fixed guide opposite to the first end portion in the horizontal direction perpendicular to the sheet feed direction, wherein the movable guide facing a lower surface of the sheet supply tray includes a third engaging portion disposed in a third end portion of the movable guide in the horizontal direction perpendicular to the sheet feed direction and a fourth engaging portion disposed in a fourth end portion of the movable guide opposite to the third end portion in the horizontal direction perpendicular to the sheet feed direction, wherein the guide surface of the movable guide is positioned relative to the guide surface of the fixed guide when the third engaging portion and the fourth engaging portion of the movable guide engage the first engaging portion and the second engaging portion of the fixed guide, respectively, and wherein the movable guide includes an upstream end portion and a downstream end portion in the sheet feed direction, the upstream end portion being connected to the urging member and including the third engaging portion and the fourth engaging portion, the downstream end portion having an axis about which the movable guide is configured to pivot.

2. The image forming apparatus according to claim 1, wherein the movable guide includes a curved portion disposed downstream thereof and configured to change the sheet feed direction, and the movable guide is configured to pivot about a downstream end portion of the curved portion.

3. The image forming apparatus according to claim 1, wherein the fixed guide is configured to be attached to and removed from the main body.

4. The image forming apparatus according to claim 1, wherein the urging member connected to the movable guide is configured to, when the sheet supply tray is removed from the main body, support the movable guide in a first position, and wherein each of the first engaging portion and the second engaging portion of the fixed guide is configured to, when the sheet supply tray is attached to the main body, engage a corresponding one of the third engaging portion and the fourth engaging portion of the movable guide supported in the first position and press the corresponding one of the third engaging portion and the fourth engaging portion of the movable guide against an urging force of the urging member such that the movable guide is moved to a second position different from the first position.

5. The image forming apparatus according to claim 4, wherein the urging member includes a tension coil spring.

6. The image forming apparatus according to claim 1, further comprising a feed roller configured to feed a sheet supplied from the sheet supply tray toward the image forming unit, wherein the movable guide is disposed at the sheet supply tray and configured to guide the sheet toward the feed roller.

7. The image forming apparatus according to claim 1, wherein the fixed guide includes at least one obliquely feeding roller disposed downstream thereof and configured to feed the sheet obliquely relative to the sheet feed direction.

8. The image forming apparatus according to claim 1, wherein a downstream end of the fixed guide includes:

a first end disposed on one end of the downstream end in the direction perpendicular to the sheet feed direction and extending in the direction;

a second end disposed adjacent to the first end and extending toward an upstream side in the sheet feed direction and toward the other end of the downstream end in the direction; and a third end disposed adjacent to the second end and on the other end of the downstream end in the direction and extending in the direction, wherein the first engaging portion is disposed adjacent to the first end on an opposite side thereof to the second end, and wherein the second engaging portion is disposed adjacent to the third end on an opposite side thereof to the second end.

9. The image forming apparatus according to claim 1, wherein the first engaging portion and the second engaging portion of the fixed guide are disposed at a downstream end portion of the fixed guide and the third engaging portion and the fourth engaging portion of the movable guide are disposed at an upstream end portion of the movable guide.

10. A sheet supply tray configured to be attached to and removed from a lower portion of a main body of an image forming apparatus, the image forming apparatus including an image forming unit and a re-feeding mechanism configured to re-feed a sheet having a first image on a first surface thereof to the image forming unit for forming a second image on a second surface of the sheet at the image forming unit, the re-feeding mechanism including a fixed guide configured to guide the sheet in a sheet feed direction toward the image forming unit, the fixed guide having a guide surface partially defining a re-feeding path through which the sheet passes, the fixed guide including a first engaging portion disposed in a first end portion of the fixed guide in a horizontal direction perpendicular to the sheet feed direction and a second engaging portion disposed in a second end portion of the fixed guide opposite to the first end portion in the horizontal direction perpendicular to the sheet feed direction, the sheet supply tray being configured to contain a stack of sheets to be supplied to the image forming unit of the image forming apparatus, the sheet supply tray comprising:

a sheet receiving portion having an upper surface, the upper surface being configured to, when the sheet supply tray is attached to the main body of the image forming apparatus, support a sheet thereon;

a base guide fixed to a lower surface of the sheet receiving portion;

a movable guide having a guide surface facing the base guide and partially defining the re-feeding path, the movable guide being configured to move toward and away from the base guide and to guide the sheet guided by the fixed guide toward the image forming unit, the movable guide including a third engaging portion disposed in a third end portion of the movable guide in the horizontal direction perpendicular to the sheet feed direction and a fourth engaging portion disposed in a fourth end portion of the movable guide opposite to the third end portion in the horizontal direction perpendicular to the sheet feed direction, the third engaging portion and the fourth engaging portion of the movable guide being configured to, when the sheet supply tray is attached to the main body of the image forming apparatus, engage the first engaging portion and the second engaging portion of the fixed guide, respectively, such that the guide surface of the movable guide is positioned relative to the guide surface of the fixed guide; and an urging member, wherein the movable guide includes an upstream end portion and a downstream end portion in the sheet feed direction, the upstream end portion being connected to the urging member and including the third engaging portion and the fourth engaging portion, the downstream end portion having an axis about which the movable guide is configured to pivot.

11. The sheet supply tray according to claim 10, wherein the urging member is configured to, when the sheet supply tray is removed from the main body, support the movable guide in a specified position.

12. The sheet supply tray according to claim 10, wherein the movable guide includes a positioning portion to be positioned by the main body of the image forming apparatus when the sheet supply tray is attached to the main body of the image forming apparatus.

* * * * *